US009395661B2

(12) United States Patent
Naraoka et al.

(10) Patent No.: US 9,395,661 B2
(45) Date of Patent: Jul. 19, 2016

(54) IMAGE FORMING APPARATUS WITH CONTROLLED TIMING OF ENERGIZATION OF HEATERS FOR POWER REDUCTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Tatsuhisa Naraoka, Shizuoka (JP); Ken Iguchi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/506,796

(22) Filed: Oct. 6, 2014

(65) Prior Publication Data

US 2016/0097998 A1 Apr. 7, 2016

(51) Int. Cl.
*G03G 15/20* (2006.01)
*G03G 15/01* (2006.01)

(52) U.S. Cl.
CPC ..... *G03G 15/2039* (2013.01); *G03G 15/01* (2013.01)

(58) Field of Classification Search
CPC ..... G03G 15/2039; G03G 15/01
USPC ..... 399/67
See application file for complete search history.

(56) References Cited

U.S. PATENT DOCUMENTS

| | | | |
|---|---|---|---|
| 5,781,822 | A | 7/1998 | Nishiyama et al. |
| 7,747,964 | B2 * | 6/2010 | Morikawa |
| 8,615,189 | B2 | 12/2013 | Imamiya et al. |
| 2010/0103458 | A1 * | 4/2010 | Negishi |
| 2011/0222084 | A1 | 9/2011 | Iguchi et al. |
| 2011/0299867 | A1 * | 12/2011 | Tanaka et al. |
| 2013/0002784 | A1 | 1/2013 | Iguchi et al. |
| 2014/0205339 | A1 | 7/2014 | Umetsu |
| 2015/0043027 | A1 * | 2/2015 | Nakata |

FOREIGN PATENT DOCUMENTS

| | | | |
|---|---|---|---|
| JP | 05119673 A | * | 5/1993 |
| JP | 05289575 A | * | 11/1993 |
| JP | 06051669 A | * | 2/1994 |
| JP | 2010139856 A | * | 6/2010 |

OTHER PUBLICATIONS

Ito et al., "Image Eraser", Nov. 5, 1993, JP05-289575a, Detailed Description, machine English translations done by JPO.*

* cited by examiner

*Primary Examiner* — Susan Lee
(74) *Attorney, Agent, or Firm* — Amin, Turocy & Watson LLP

(57) ABSTRACT

In accordance with one embodiment, an image forming apparatus has a fixing section that transfers a toner image to a recording medium for printing in a printer section and then fixes the toner image, a decoloring section that heats and decolors a decolorable image printed on a recording medium for reuse with a color material of which the color is decolored if heated at a decoloring temperature, and a controller that enables the fixing section and the decoloring section to operate exclusively.

3 Claims, 5 Drawing Sheets

IMAGE FORMING APPARATUS WITH CONTROLLED TIMING OF ENERGIZATION OF HEATERS FOR POWER REDUCTION

FIELD

Embodiments described herein relate to a power control technology of an image forming apparatus.

BACKGROUND

Conventionally, it is general to arrange, in two devices which are independent from each other, a decoloring function of decoloring an image printed on a recording medium such as a sheet and the like with decolorable material using a decoloring section and a printing function of printing the image on the recording medium.

However, if such a decoloring function and a printing function can be arranged in one single apparatus, the installation space can be reduced, and therefore, an apparatus (hereinafter referred to as image forming apparatus for short) equipped with the decoloring function and the printing function has been proposed.

In such an image forming apparatus, in a case of forming an image with a toner melted by heating at a fixing temperature, a toner image on a recording medium is heated, pressed and fixed by a fixing section which is heated through energization to a heater thereof. Further, if the decolorable material is a decolorable toner of which the color is decolored when being heated at a decoloring temperature, the decolorable toner image printed on the recording medium is heated and decolored by the decoloring section which is heated through energization to a heater thereof.

In a case in which the fixing section and the decoloring section, which are heated through energization to a heater thereof, are respectively arranged, and a sheet conveyance path used for fixing an image and a sheet conveyance path used for decoloring an image are respectively arranged, it is possible to carry out printing operation and decoloring operation simultaneously.

However, the situation in which the printing function and the decoloring function are operated simultaneously is very limited. For this reason, when a standby mode of the fixing section and the decoloring section is started from a power saving mode, it is not a good idea to energize the heaters of the fixing section and the decoloring section simultaneously.

Thus, it is desired to suppress unnecessary power consumption by controlling timing of energization for the heaters of the fixing section and the decoloring section.

DETAILED DESCRIPTION

In accordance with one embodiment, an image forming apparatus comprises: a fixing section configured to transfer a toner image to a recording medium for printing in the printer section and then fix the toner image; a decoloring section configured to heat and decolor a decolorable image printed on a recording medium for reuse with a color material of which the color is decolored if heated at a decoloring temperature; and a controller configured to enable the fixing section and the decoloring section to operate exclusively.

Hereinafter, the image forming apparatus according to the present embodiment is described in detail with reference to the accompanying drawings.

Figure 1:
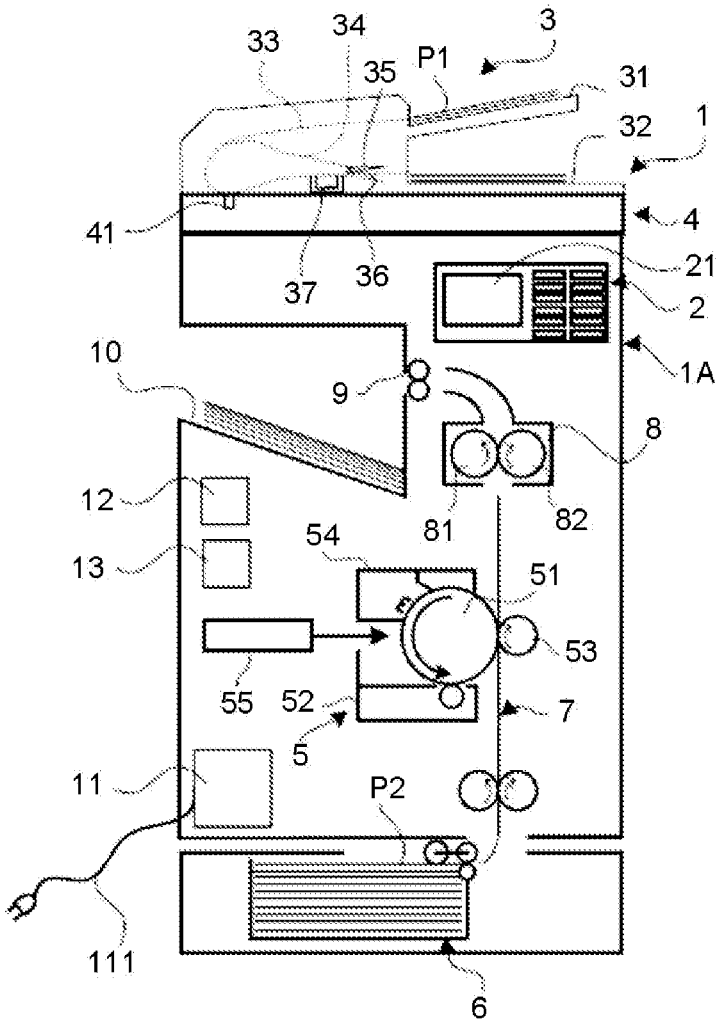
FIG. 1 is a schematic view illustrating an image forming apparatus according to an embodiment.
Figure 2:
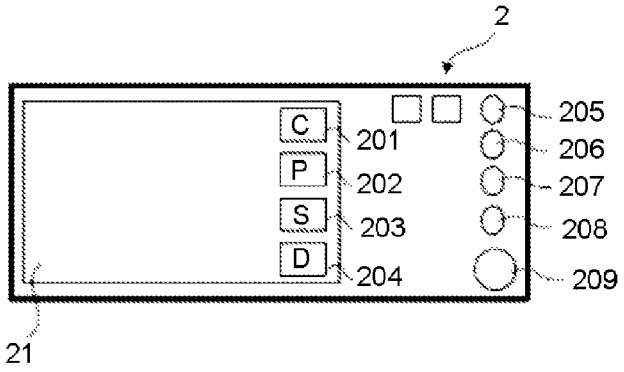
FIG. 2 is a schematic view illustrating an operation section of the image forming apparatus shown in FIG. 1.
Figure 3:
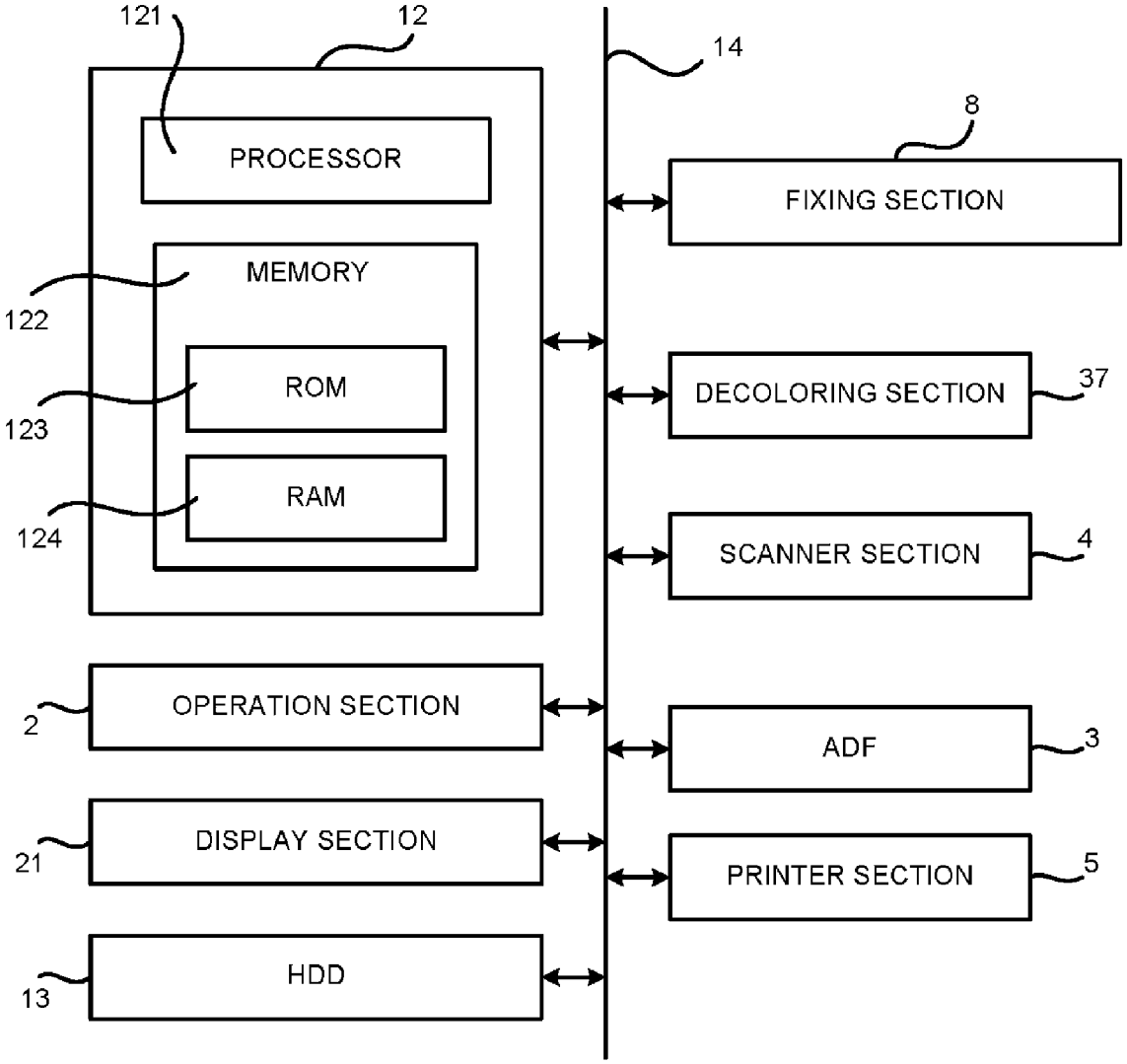
FIG. 3 is a block diagram illustrating the hardware constitution of the image forming apparatus shown in FIG. 1.

FIG. 1 is a schematic view illustrating the image forming apparatus according to the embodiment, FIG. 2 is a schematic view illustrating an operation section of the image forming apparatus shown in FIG. 1, and FIG. 3 is a block diagram illustrating the hardware constitution of the image forming apparatus shown in FIG. 1.

In FIG. 1, an image forming apparatus 1 is provided with a printing function for carrying out a printing processing and a decoloring function for carrying out a decoloring processing to reuse a recording medium. A printing processing section, which executes the printing function, transfers a toner image melted at a fixing temperature onto a recording medium such as a sheet and the like, and fixes the toner image on the recording medium with heat and pressure by a fixing device. A decoloring processing section executing the decoloring function decolors an image printed with a decolorable toner serving as decolorable material of which the color is decolored if heated at a decoloring temperature. The toner used for the printing function may be or may not be a decolorable toner.

The decolorable material contains a color generation compound, a color developing agent and a decoloring agent. The color generation compound is, for example, leuco dye. The color developing agent is, for example, phenols. The decoloring agent is, for example, a material which, when heated, is dissolved with the color generation compound and has no affinity with the color developing agent. The decolorable material generates a color through the interaction of the color generation compound and the color developing agent and is decolored after being heated to a temperature higher than a decoloring temperature to eliminate the interaction of the color generation compound and the color developing agent.

The "decolor" in the present embodiment means preventing an image which is formed in a color (including not only a chromatic color but also an achromatic color such as white, black, etc.) different from the color of the base color of a paper from being seen visually. Herein, "preventing the image from being seen visually" may be a constitution in which the color of the image formed in a color different from the base color of the paper may be changed to the same color with or a similar color to the base color of the paper, in addition to a from in which the image formed in a color different from the base color of the paper becomes colorless (transparent).

The image forming apparatus 1 is provided with an automatic document feeder (ADF) 3 above an apparatus main body 1A. A scanner section 4 is arranged above the apparatus main body 1A. The ADF 3 serves as both the automatic document reading function and the decoloring function.

A printer section 5, a sheet feed cassette section 6, a sheet conveyance path 7 of a recording medium P2 for printing, a fixing section 8, a sheet discharge roller 9, a sheet discharge section 10, an operation section 2 serving as an input section, a power supply section 11, a controller 12 for controlling the whole image forming apparatus 1, a storage section 13 and the like are arranged inside the apparatus main body 1A.

A sheet feed tray 31 and a sheet discharge tray 32 are connected by a U-shape sheet conveyance path 33 in the ADF 3. In the sheet conveyance path 33, a reversal conveyance path 34 used for reversing the front surface and the back surface of a sheet is arranged. A sheet conveyed on the sheet conveyance path 33 is discharged to the sheet discharge tray 32 through the switching of a switching member 35. During the reading process of a document image by the ADF 3, the scanner section 4 moves a scanning optical section 41 to stop it at a position shown in FIG. 1. In a case of carrying out a double-sided image reading, a sheet is conveyed on the sheet conveyance path 33 from the sheet feed tray 31, and then is discharged to and stopped at the middle of the sheet discharge tray 32 without being obstructed by the switching member 35 after an image of the first surface of the sheet is read by the scanning optical section 41. In order to read an image of the second surface of the sheet, the sheet which is stopped at the middle of the sheet discharge tray 32 is conveyed to the reversal conveyance path 34 by switching the switching member 35. The sheet passing the reversal conveyance path 34 is conveyed to the sheet conveyance path 33, and then is discharged to the sheet discharge tray 32 after the second surface of the sheet is read by the scanning optical section 41.

On the sheet conveyance path 33, a decoloring section 37 is arranged between the stopping position of the scanning optical section 41 and the branching position 36 of the reversal conveyance path 34.

The ADF 3 can decolor the image (hereinafter recorded as decolorable toner image) which is formed with decolorable toner and printed on the recording medium by heating the decoloring section 37 to a decoloring temperature. That is, when the reuse recording medium P1 is stacked on the sheet feed tray 31, a decoloring mode is selected on the operation section 2 and the start switch is turned on, the reuse recording medium P1 is sequentially conveyed on the sheet conveyance path 33, the image on which is read by a scanning optical section 41, and the decolorable toner image on which is decolored by the decoloring section 37. Further, the second surface of the sheet is read and decolored through the switching of the sheet by the switching member 35. Moreover, the read image is stored in the storage section 13.

Moreover, a decoloring section, a reuse recording medium conveyance path and the like may also be arranged in an image forming apparatus independent from the ADF, although the ADF 3 also serves as the decoloring function in the present embodiment. Further, a decoloring section may also be arranged on a finisher installed in the apparatus main body 1A.

The printer section 5 is provided with a developer 52, a transfer roller 53, a cleaning section 54 and the like around a photoconductive drum 51. The photoconductive drum 51 is irradiated with an image light such as the laser and the like by an image exposure section 55 to form an electrostatic latent image on the surface thereof. The electrostatic latent image is developed using the toner of the developer 52. Then, the toner image is transferred onto the recording medium P2 for printing by the transfer roller 53.

The recording medium P2 for printing which is stored in the sheet feed cassette 6 is conveyed on the sheet conveyance path 7 to the fixing section 8 after passing through a nip section between the transfer roller 53 and the photoconductive drum 51.

In the fixing section 8, a press roller 82 is brought into pressure contact with a heat roller 81, and the recording medium P2 for printing on which the toner image is transferred but unfixed passes through a nip section between the heat roller 81 and the press roller 82. The unfixed toner image is fixed on the recording medium P2 for printing by heat and pressure with the fixing section 8. The recording medium P2 for printing on which the toner image is fixed is discharged to the sheet discharge section 10 by the sheet discharge roller 9. Although a monochrome printer section is exemplified in the present example, a full color printer section may also be used.

The power supply section 11 steps up/steps down the commercial power supply powered by a power supply cord 111 to a required voltage, and then supplies the obtained voltage to each component of the image forming apparatus 1 including the fixing section 8 and the decoloring section 37 which consume a large power.

The hardware constitution of the image forming apparatus 1 is described based on the block diagram shown in FIG. 3. The controller 12, the operation section 2, a display section 21, the storage section (HDD) 13, the fixing section 8, the decoloring section 37, the scanner section 4, the ADF 3, the printer section 5 are connected with a bus 14. The ADF 3, the scanner section 4 and the decoloring section 37 are operated during the decoloring operation, while the printer section 5, the fixing section 8 and the sheet conveyance path 7 are operated during the printing operation.

The controller 12 includes a processor 121 including a CPU (Central Processing Unit) or a MPU (Micro Processing Unit) and a memory 122.

The memory 122, for example, is a semiconductor memory, and includes a ROM (Read Only Memory) 123 used for storing various control programs, and a RAM (Random Access Memory) 124 used for providing a temporary work area for the processor 121. The processor 121 executes the processing for the fixing section 8 and the decoloring section 37 according to the flowcharts shown in FIG. 4, FIG. 5 and FIG. 7.

The controller 12 controls the power supply to each component of the image forming apparatus 1. The fixing section 8 and the decoloring section 37 include, for example, a heat source such as a halogen lamp and a temperature sensor and the like. The controller 12 respectively controls the fixing section 8 and the decoloring section 37 to the setting temperature, based on, for example, the detection temperature of the temperature sensor.

Various modes for controlling energization to each heat source of the fixing section 8 and the decoloring section 37 by the controller 12 are stored in the ROM 123. As shown in FIG. 2, the selection of various modes is carried out through the operation section 2.

In FIG. 2, the operation section 2 comprises a display panel 21, various operation switches 201~204 arranged as touch switches in the display panel 21, various mode selection switches 205~208 arranged outside the display panel 21, a start switch 209 and the like. As various operation switches, a copy switch 201 used for copying the document read by the scanner section 4, a print switch 202 used for printing the document of a personal computer, a USB memory and the like, a scan switch 203 used for carrying out the reading of the document through the scanner section 4, and a decoloring switch 204 used for carrying out a decoloring processing are arranged.

If the copy switch 201 and the print switch 202 are selected, and because the printer section 5 and the fixing section 8 are operated, thus, a case is exemplified in the following description in which the copy switch 201 is selected.

As various mode selection switches, a power saving mode switch 205 used for selecting a power saving (sleep) mode, a reception rejection mode switch 206, a reception permission mode switch 207 and a priority mode switch 208 are provided.

The controller 12 executes a warming up (restoring) mode in a case in which the main power supply is turned on to carry out power supply to each device, in a case in which the fixing section 8 and the decoloring section 37 are restored from a state in which the power supply is interrupted during a power saving mode, or in a case in which the door is closed at the end time of maintenance of each device of the apparatus. Then, the controller 12 waits for an instruction of the copy (printing) operation, or the decoloring operation. During the waiting period, a preheating mode used for performing preheating for the fixing section 8 and the decoloring section 37 is executed to suppress the temperature decrease. Then, if a copy (printing) operation or a decoloring operation is instructed, a standby mode, which is used for heating the fixing section 8 and the decoloring section 37 to a temperature at which the fixing section 8 and the decoloring section 37 can be operated, is executed.

In the warming up (restoring) mode, as the fixing section 8 and the decoloring section 37 are cooled, and therefore, the power consumption used for heating the fixing section 8 and the decoloring section 37 to a given warming up temperature becomes quite large. Further, even in the standby mode, the power consumption of the fixing section 8 and the decoloring section is also very large. Thus, it is necessary to avoid simultaneous energization to the fixing section 8 and the decoloring section 37 in the warming up (restoring) mode and the standby mode.

In the warming up mode, the controller 12 shifts the energization timing for the fixing section 8 and decoloring section 37, for example, performs the warming up of the other one after the ending of the warming up of one of the fixing section 8 and the decoloring section 37.

Further, the controller 12 determines whether or not an ON signal of the power saving switch 205 is acquired, and if it is determined that no processing has been performed during a certain period of time, the controller 12 executes a power saving mode. If some input signal is acquired during the power saving mode, the controller 12 carries out a restoring processing for executing a printing processing, a decoloring processing, a scan processing and the like in response to type of the input signal.

On the other hand, in order to avoid a power consumption that exceeds the allowable range of the power supply section 11, it is necessary to avoid simultaneous printing operation and decoloring operation.

For example, if the decoloring operation is selected during a printing operation, the decoloring section 37 becomes the standby mode, and a large power is consumed together with the fixing section 8 which is being operated.

In the present embodiment, the controller 12 includes, for example, a reception rejection mode (referred to as A mode) used for rejecting the reception itself of a decoloring operation, and for example, a reception permission mode (referred to as B mode) for carrying out energization to the standby mode for the decoloring section 37 by waiting the ending of the printing operation (for example, setting the fixing section 8 to the preheating mode) as the reception of the decoloring operation is permitted If the operator selects the A mode, the reception rejection mode switch 206 is turned on. For example, if an ON signal of the reception rejection mode switch 206 is acquired in the selection status of the copy switch 201, the controller 12 grays out the display of the decoloring switch 204. Thus, even the decoloring switch 204 is pressed, the switch is not turned on, i.e., the reception thereof is rejected.

If the operator selects the B mode, the reception permission switch 207 is turned on. For example, if an ON signal of the decoloring switch 204 is acquired during the copy operation in the ON state of the copy switch 201, the controller 12 permits the reception of the ON information of the decoloring switch 204. However, the controller 12 waits for the completion of the copy operation which is being operated currently, sets the decoloring section 37 to the standby mode to avoid simultaneous large power consumption of the decoloring section 37 and the fixing section 8.

After the operation is ended, for example, in a case in which the power supply to the decoloring section 37 (or the fixing section 8) that is enabled not to operate is completely interrupted, it requires a longer time to heat the decoloring section 37 (or the fixing section 8) to a standby temperature. Thus, the controller 12 carries out preheating for the decoloring section 37 (or the fixing section 8) that is not being operated currently. In this case, as the standby energization to the decoloring section 37 (or the fixing section 8) has not been performed, there is sufficient power. Therefore, a preheating operation is carried out using the sufficient power. As a result, the decoloring section 37 (or the fixing section 8) is maintained at a temperature close to the temperature of the standby mode. Further, as other preheating method, the interval (the passing interval of the recording medium P2 for printing passing through the fixing section 8) of job of the fixing section 8 (decoloring section 37) which is being operated currently is made longer, and the power is supplied to the decoloring section 37 (fixing section 8) which is not being operated currently to carry out preheating operation during the obtained longer interval. As a result, it is possible to shorten the rise time to reach the standby temperature while suppressing energy consumption.

Preheating mode is performed in order to maintain the temperature as close as possible to the temperature of the standby mode as described above. The preheating mode is set by turning on the priority mode switch 208 by the operator. If an ON signal of the priority mode switch 208 is acquired, the controller 12 displays a selection screen (not shown) of a printing processing or a decoloring processing on the display section 21. Through selecting the selection screen of a printing processing or a decoloring processing by the operator, it can be selected whether to prioritize the preheating of either the fixing section 8 or the decoloring section 37. On the other hand, if the operator does not select the selection screen mentioned above, whether to prioritize the preheating of either the fixing section 8 or the decoloring section 37 can be determined with reference to the latest job. Checking the latest job, the preheating of the fixing section 8 is prioritized if the printing operation is more, and the preheating of the decoloring section 37 is prioritized if the decoloring operation is more. The latest job may be exemplified as, for example, the last job, or multiple jobs going back from the last job, jobs in a specific time (e.g. 1 hour, 6 hours, 12 hours, etc.) from the last job, or in the prescribed number of days and the like. Moreover, the latest job which is not limited to these exemplified forms may be a last job or a past job including the last job.

That is, it is determined to prioritize the usage of the image forming apparatus 1 as a printer or as a decoloring apparatus by the user.

Operating frequency of printing job and decoloring operation is different depending on the user, the fixing section 8 and the decoloring section 37 are set to be preheated with the same priority degree at shipment from a factory of the image forming apparatus 1, and the priority degree may be changed based on the usage history of the user. Further, it may be set that the user can select the priority degree by shortening the rise time of the printing operation. For example, in a case in which the rise time of the printing operation is set to be shortest, then it is heated to a specific temperature after the start of the decoloring operation.

Figure 6:
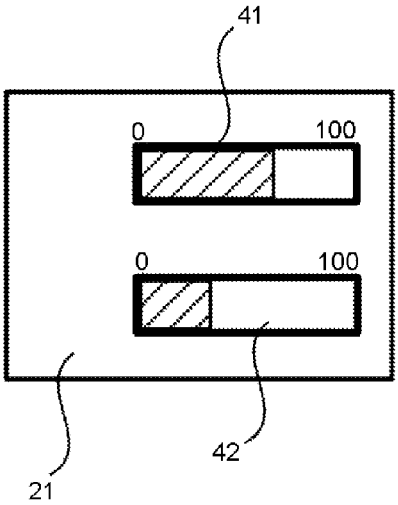
FIG. 6 is a diagram illustrating a preheating display section for displaying a preheating state of the fixing section and the decoloring section.

Further, as shown in FIG. 6, on the display section 21, a first temperature display section 41 which displays the temperature of the fixing section 8 and a second temperature display section 42 which displays the temperature of the decoloring section 37 are displayed, and the user is informed that how much the fixing section 8 and the decoloring section 37 are heated during ready time. Thus, the user can know the time when the printing processing or the decoloring processing can be performed.

Figure 4:
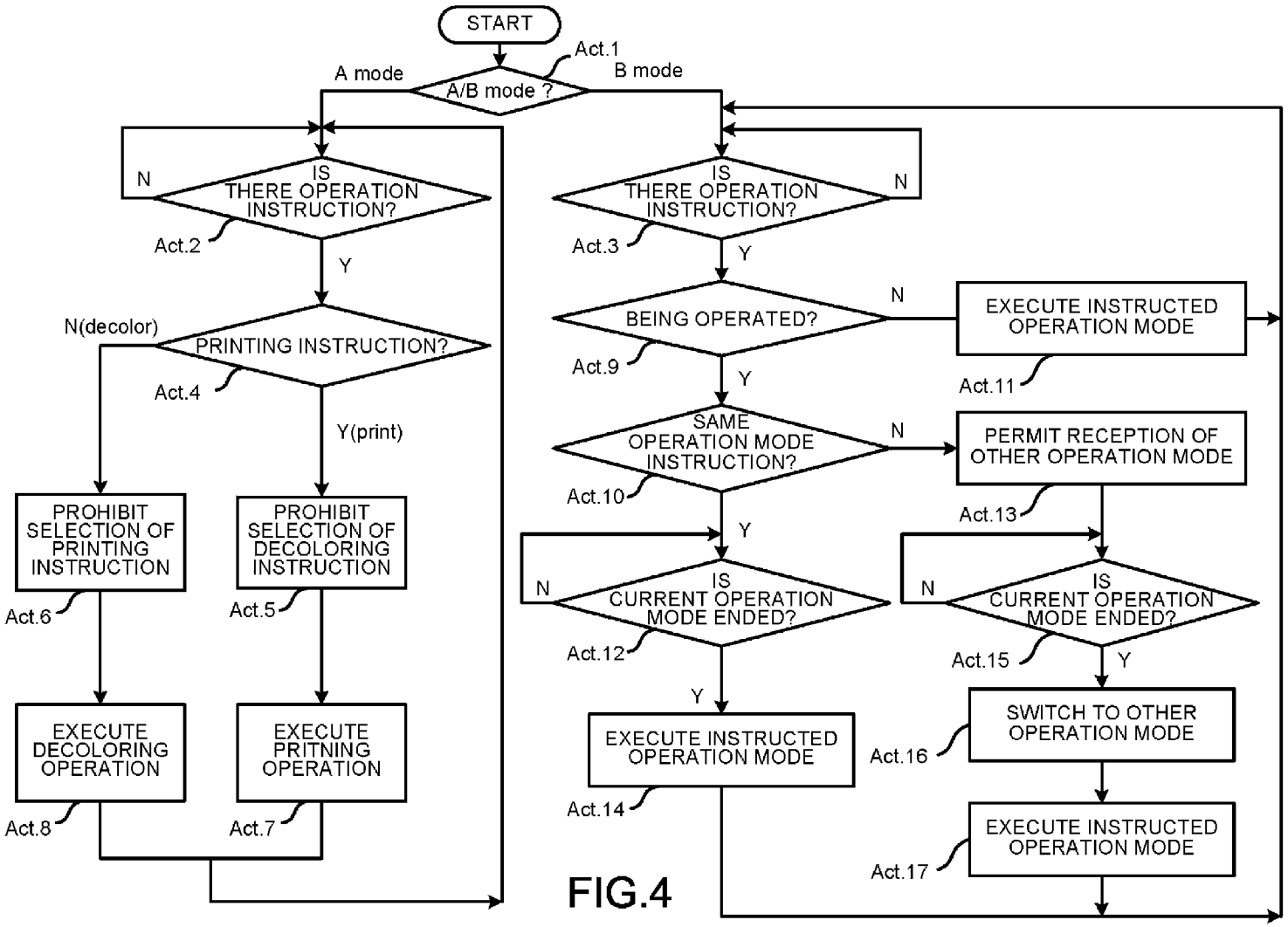
FIG. 4 is a flowchart illustrating a reception rejection mode and a reception permission mode of an energization operation for a fixing section and a decoloring section.
Figure 5:
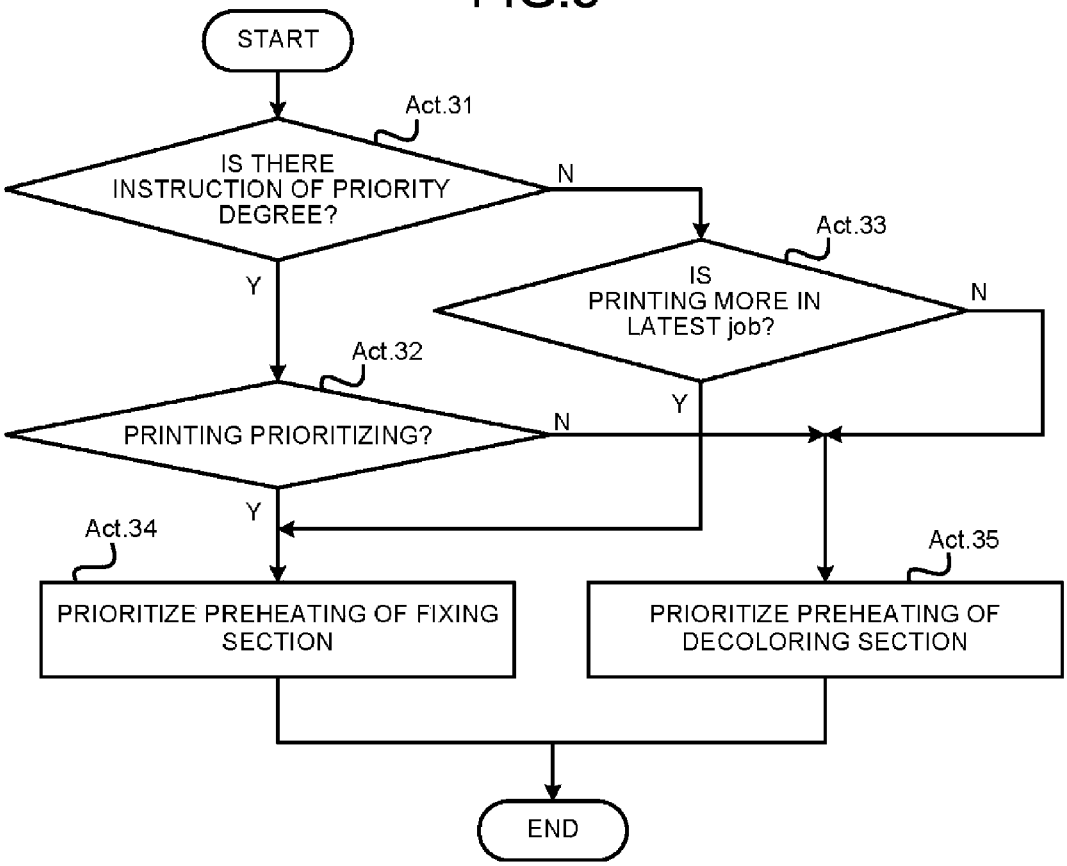
FIG. 5 is a flowchart illustrating a priority mode of the energization operation for the fixing section and the decoloring section.

Next, the energization operation of the heat sources of the fixing section 8 and the decoloring section 37 carried out by the controller 12 is described based on the flowcharts shown in FIG. 4 and FIG. 5.

FIG. 4 relates to a processing of enabling the fixing section 8 and the decoloring section 37 to exclusively operate not to be in a standby state at the same time when restoring from the power saving mode to the standby state. That is, the exclusive operation refers to one through which the decoloring section 37 is set in a non-standby state if the fixing section 8 is set in a standby state, or one through which the fixing section 8 is set in a non-standby state if the decoloring section 37 is set in a standby state. As an operation through which a component is set in a non-standby state, a state in which there is no power consumption such as the preheating mode, the power saving mode and the like, or a state in which the power consumption is smaller than that in the standby state can be exemplified.

In ACT 1, it is determined whether to select A mode (the reception rejection mode) or B mode (reception permission mode), and ACT 2 is taken if it is determined to select A mode, and ACT 3 is taken if it is determined to select B mode.

In ACT 2, it is determined whether or not there is an operation instruction by determining whether an ON signal of the copy switch 201 or that of the decoloring switch 204 is acquired. If there is an operation instruction (YES in ACT 2), ACT 4 is taken.

In ACT 4, it is determined whether or not the operation instruction is a printing operation, and ACT 5 is taken if it is a printing operation (YES in ACT 4), and ACT 6 is taken if it is a decoloring operation (NO in ACT 4).

In ACT 5, the display of the decoloring switch 204 is grayed out, and the selection of a decoloring instruction is prohibited, and then ACT 7 is taken.

In ACT 7, for example, the fixing section 8 that is controlled to be preheated is energized to reach a standby temperature to execute a printing operation, and then ACT 2 is taken.

In ACT 6, the display of the printing switch 201 is grayed out, and the selection of a printing instruction is prohibited, and then ACT 8 is taken.

In ACT 8, for example, the decoloring section 37 that is controlled to be preheated is energized to reach a standby temperature to execute a decoloring operation, and then ACT 2 is taken.

That is, in the reception rejection mode (A mode), the reception of the instruction of the operation different from the operation being executed (printing operation or decoloring operation) is rejected. Thus, it is possible to avoid a state in which the fixing section 8 and the decoloring section 37 are energized to reach the standby temperature at the same time.

On the other hand, if it is determined that B mode is selected in ACT 1, it is determined whether or not there is an operation instruction in ACT 3 by determining whether an ON signal of the copy switch 201 or that of the decoloring switch 204 is acquired. If there is an operation instruction (YES in ACT 3), ACT 9 is taken.

In ACT 9, it is determined whether or not the image forming apparatus is being operated, and ACT 10 is taken if it is being operated (YES in ACT 9), and ACT 11 is taken if it is not being operated (NO in ACT 9).

In ACT 10, it is determined whether or not an operation mode in which the instruction is received is consistent with the current operation mode, and ACT 12 is taken if they are consistent, and ACT 13 is taken if they are not consistent.

In ACT 12, if the current operation mode is ended, and then ACT 14 is taken.

In ACT 14, an operation mode the same as the last time instruction operation is executed, and then ACT 3 is taken.

In ACT 10, if it is determined that an operation mode in which the instruction is received is not consistent with the current operation mode, the reception of an operation mode in which an instruction different from the current operation mode is received is permitted in ACT 13, and then ACT 15 is taken.

In ACT 15, if the current operation mode is ended, and then ACT 16 is taken.

In ACT 16, the operation mode is switched to other operation mode, and then ACT 17 is taken.

In ACT 17, a newly instructed operation mode is executed, and then ACT 3 is taken.

In the reception permission mode (B mode), it is assumed that for example, a decoloring mode is selected as a next operation mode when, for example, a printing mode is being executed. In this case, as the reception of the decoloring mode is permitted, once the printing mode is ended, the execution of the next decoloring mode is started immediately.

Moreover, during the warming-up operation being carried out when the power supply switch is turned on, the controller 12 determines whether to prioritize either the printing operation or the decoloring operation. The determination may be set to prioritize the operation mode used more frequently based on a preset or the use history of the image forming apparatus 1 stored in the storage section 13.

Further, it may be performed that the selected operation mode is prioritized to be restored according to whether the user turns on the copy switch 201 (print switch 202) or the user turns on the decoloring switch 204 when restoring from the power saving mode (sleep mode) to the standby mode. Of course, the determining method of restoring the decoloring operation mode and the printing operation mode may also be determined according to a priority method the same as that of the warming up.

FIG. 5 relates to a processing carrying out preheating energization while energization to the fixing section 8 and the decoloring section 37 are not interrupted completely after the printing operation mode or the decoloring operation mode is ended.

In ACT 31, it is determined whether or not there is an instruction of priority degree of an operation (printing operation or decoloring operation), and ACT 32 is taken if there is an instruction of priority degree (YES in ACT 31), and ACT 33 is taken if there is no instruction of priority degree (NO in ACT 31). That is, in the image forming apparatus 1, a priority degree of whether to set a printing operation mode or a decoloring operation mode in the standby state is instructed. Thus, if the printing operation mode is selected as the prioritizing operation mode, the user prioritizes using the image forming apparatus 1 as the printing apparatus, and if the decoloring operation mode is selected as the prioritizing operation mode, the user prioritizes using the image forming apparatus 1 as the decoloring apparatus.

In ACT 32, it is determined whether or not the instructed priority degree is the printing prioritizing, and ACT 34 is taken if it is the printing prioritizing (YES in ACT 32).

In ACT 34, the preheating process as the preheating prioritizing is executed for the fixing section 8, and then the present processing is ended.

In a case in which there is no instruction on the preheating prioritizing, it is determined whether or not the printing mode is more in the latest job in ACT 33. If it is determined that the printing mode is more (YES in ACT 33), ACT 34 is taken, while if it is determined that the printing mode is not more (NO in ACT 33), ACT 35 is taken. Further, the determination on whether or not the printing mode in the latest job is more may be performed with reference to, for example, the job (printing instruction or decoloring instruction) received by the controller during a predetermined period in the past.

In ACT 35, the preheating process as the preheating prioritizing is executed for the decoloring section 37, and then the present processing is ended.

That is, in a case in which the image forming apparatus 1 is prioritized to be used as a printing apparatus, since it will be used as the printing apparatus again after the operation is ended, the image forming apparatus 1 may be set to be capable of heating to reach the standby temperature with a short time by preheating the fixing section 8. In a case in which the image forming apparatus 1 is prioritized to be used as a decoloring apparatus, the image forming apparatus 1 may be set to be capable of heating to reach the standby temperature with a short time by preheating the decoloring section 37 after the operation is ended.

Further, in a case in which it is not defined whether the image forming apparatus 1 is used as the printing apparatus or the decoloring apparatus, or in a case in which the image forming apparatus 1 is only used as either the decoloring apparatus or the printing apparatus, the next operation is also regarded as one the same as the current operation according to the latest use state, and then a preheating is carried out. Thus, the next operation may be started within a short period of time.

Figure 7:
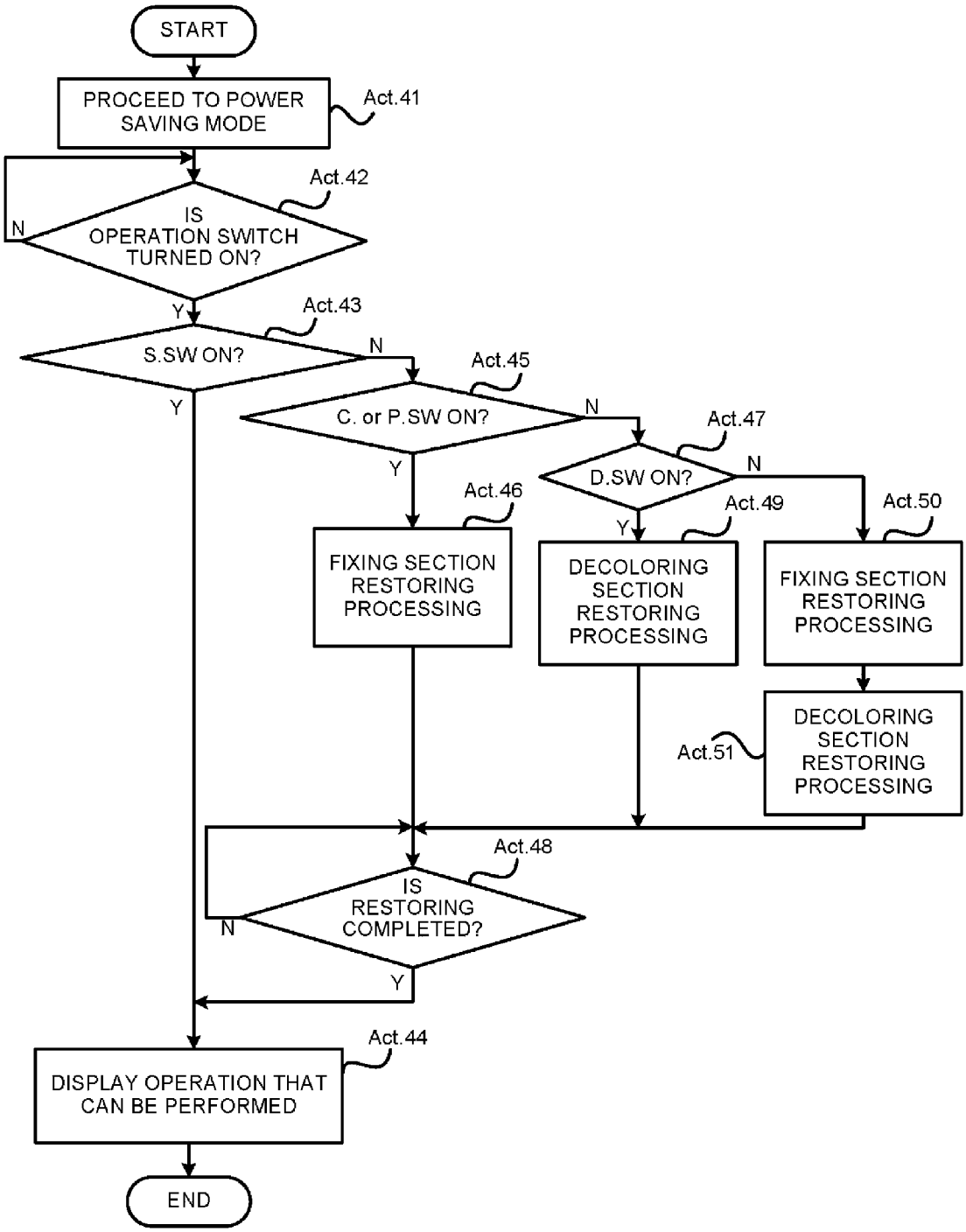
FIG. 7 is a flowchart illustrating energization operation for the fixing section and the decoloring section when restoring from the power saving mode.

Energization operation to the fixing section and the decoloring section carried out by the controller 12 when restoring from the power saving mode is described with reference to the flowchart shown in FIG. 7. Moreover, in FIG. 7, C. SW represents the copy switch 201, P. SW represents the print switch 202, S. SW represents the scan switch 203, and the D. SW represents the decoloring switch 204.

In ACT 41, the power saving mode is started. The power saving mode is started when the power saving mode switch 205 is turned on, or a given time elapses after a printing operation, a decoloring operation, a scan operation and the like is ended.

In ACT 42, the controller 12 waits for acquiring some particular signal, and then ACT 43 is taken. As some particular signal, it may be any signal as long as it is one input to the controller 12 in the image forming apparatus 1. For example, it may be exemplified as ON signals of the operation switches 201~204. If the controller 12 acquires one of the ON signals of the operation switches 201~204, the processing in ACT 43 is carried out.

In ACT 43, it is determined whether or not the operation switch of which the ON signal is acquired is the S. SW 203. If it is determined that the S. SW 203 is turned on (YES in ACT 43), ACT 44 is taken. If it is determined that the S. SW 203 is not turned on (NO in ACT 43), ACT 45 is taken. In ACT 45, that the scan operation is possible is displayed on the display section 21.

In ACT 45, it is determined whether or not the operation switch of which the ON signal is acquired is the C. SW 201 or the P. SW 202. If it is determined that the C. SW 201 or the P. SW 202 is turned on (YES in ACT 45), ACT 46 is taken. If it is determined that the C. SW 201 or the P. SW 202 is not turned on (NO in ACT 45), ACT 47 is taken.

In ACT 46, a fixing section restoring processing of heating the fixing section 8 to a standby temperature is executed, and then ACT 48 is taken.

In ACT 48, it is determined whether or not the restoring processing is ended, and in this case, if the fixing section restoring processing is ended, ACT 44 is taken, i.e., the display of printing operation that can be performed is carried out on the display section 21, and then the present processing is ended.

In ACT 47, it is determined whether or not the operation switch of which the ON signal is acquired is the D. SW 204. If it is determined that the D. SW 204 is turned on (YES in ACT 47), ACT 49 is taken. If it is determined that the D. SW 204 is not turned on (NO in ACT 47), ACT 50 is taken.

In ACT 49, a decoloring section restoring processing of heating the decoloring section 37 to a standby temperature is executed, and then ACT 48 is taken. In ACT 48, it is determined whether or not the restoring processing is ended, and in this case, if the decoloring section restoring processing is ended, ACT 44 is taken, i.e., the display of decoloring operation that can be performed is carried out on the display section 21, and then the present processing is ended.

The reason that it is determined in ACT 47 that the operation switch of which the ON signal is acquired is not the D. SW 204, is because any one of the operation switches 201~204 is not turned on. That is, the processing in ACT 50 and ACT 51 is the operation carried out in a case where the controller 12 acquires a signal of operation instruction that is not directly associated with the printing processing and the decoloring processing in the power saving mode. In this case, there is a possibility that the printing processing or the decoloring processing is instructed in the next operation. Thus, in ACT 50, first the fixing section restoring processing is carried out, next ACT 51 is taken, the decoloring section restoring processing is carried out, and then ACT 48 is taken. It may be performed that the decoloring section restoring operation is carried out in ACT 50 and the fixing section restoring operation is carried out in ACT 51.

In ACT 50, for example, after the fixing section 8 is energized to the standby temperature, for example, the preheating mode is started to lower the power consumption of the fixing section 8. Then, in ACT 51, the decoloring section 37 is energized to the standby temperature, and then the preheating mode is started. In this case, the fixing section 8 and the decoloring section 37 don't enter the standby mode at the same time. Thus, large power consumption can be avoided. Then, if it is determined that the restoring processing of the fixing section 8 and the decoloring section 37 is completed in ACT 48, and then ACT 44 is taken. In ACT 44, the display of both the printing operation and the decoloring operation that can be performed is carried out, and then the present processing is ended.

In a case where the power supply to the fixing section 8 and the decoloring section 37 is interrupted in the power saving mode, it takes some time to heat the fixing section 8 and the decoloring section 37 to a standby temperature, and further large power is consumed. On the other hand, as the use purpose of the printing operation and the decoloring operation is different, the situation in which the user utilizes both functions mentioned above at the same time is very limited. In such a situation, restoring both functions from the power saving mode to the standby mode at the same time becomes wasteful from the point of view of power consumption and the like.

Operation switches 201~204 function as switches capable of restoring from the power saving mode. Then, if the switch relating to printing such as the copy switch 201, the print switch 202 and the like is turned on, the restoring operation of the printing section is carried out without waiting for turn-on of the start switch 209. Further, if the switch relating to document reading such as the scan switch 203, the decoloring switch 204 and the like is turned on, the restoring operation of the decoloring section is carried out without waiting for turn-on of the start switch 209.

Thus, if the user turns on the start switch 209 in practice, it is possible to execute the printing operation or the decoloring operation immediately.

Further, a decoloring processing in which an image is decolored by heating in the present embodiment is exemplified. However, the present invention is not limited to this embodiment. For example, "decoloring processing" described above may be a processing in which an image on a sheet is decolored by the irradiation of light, or may be a processing in which an image formed on a special sheet is decolored. Alternatively, it may also be a processing in which an image on a sheet is eliminated (erased). That is, "decoloring processing" may be in any form as long as it is a processing capable of preventing an image on a sheet from being seen to make the sheet reusable.

The embodiment described herein may be embodied in a variety of other forms without departing from the spirit or the main features of the inventions. Thus, the embodiment described above has been presented by way of example only, and is not to be construed as limiting. The scope of the present invention is one indicated by the scope of the accompanying claims, and is not restricted in the specification. Moreover, all modifications, various improvements, substitutions and changes belonging to the equivalent scope of the accompanying claims are within the scope of the present invention.

What is claimed is:

1. An image forming apparatus, comprising:

a fixing section configured to fix a toner image which is transferred to a recording medium for printing in a printer section;

a decoloring section configured to heat and decolor a decolorable image printed on a recording medium with a color material of which the color is decolored if heated at a decoloring temperature;

a storage section configured to store whether a printing operation or a decoloring operation is more in a last job or in a past job including the last job; and a controller configured to limit, if the controller carries out either one of the printing operation or the decoloring operation, carrying out the other operation, the controller configured to enable the image forming apparatus to restore to an operation which is more in the job stored in the storage section when restoring from a warming up mode or a power saving mode.

2. An image forming apparatus, comprising:

a fixing section configured to fix a toner image which is transferred to a recording medium for printing in a printer section;

a decoloring section configured to heat and decolor a decolorable image printed on a recording medium with a color material of which the color is decolored if heated at a decoloring temperature; and a controller configured to limit, if the controller carries out either one of a printing processing or a decoloring processing, carrying out the other processing, the controller configured to carry out, if some particular signal is acquired during a power saving mode, a restoring processing to the printing processing or the decoloring processing according to type indicated by the acquired signal.

3. The image forming apparatus according to claim 2, wherein the controller continuously carries out, if a signal of instruction of an operation not relating to a printing processing and a decoloring processing directly is acquired during the power saving mode, restoring operations of the printing processing and the decoloring processing.

* * * * *